US012540604B2

(12) United States Patent
Andersen et al.

(10) Patent No.: US 12,540,604 B2
(45) Date of Patent: Feb. 3, 2026

(54) CONTROL PLATE OF A HYDRAULIC MACHINE AND HYDRAULIC MACHINE

(71) Applicant: Danfoss A/S, Nordborg (DK)

(72) Inventors: Stig Kildegaard Andersen, Krusaa (DK); Poul Erik Hansen, Aabenraa (DK); Olaf Worm, Tarp (DE)

(73) Assignee: DANFOSS A/S, Nordborg (DK)

( * ) Notice: Subject to any disclaimer, the term of this patent is extended or adjusted under 35 U.S.C. 154(b) by 0 days.

(21) Appl. No.: 18/517,151

(22) Filed: Nov. 22, 2023

(65) Prior Publication Data

US 2024/0175429 A1 May 30, 2024

(30) Foreign Application Priority Data

Nov. 28, 2022 (EP) ..... 22209777

(51) Int. Cl.
*F04B 1/303* (2020.01)
*F04B 1/2042* (2020.01)

(52) U.S. Cl.
CPC ..... *F04B 1/303* (2013.01); *F04B 1/2042* (2013.01)

(58) Field of Classification Search
CPC ..... F04B 1/303; F04B 1/2042; F04B 53/108; F04B 1/122
See application file for complete search history.

(56) References Cited

U.S. PATENT DOCUMENTS 3,795,179 A 3/1974 Picker
5,598,761 A 2/1997 Kristensen et al.
5,890,412 A * 4/1999 Martensen ..... F04B 1/2042 91/499
2005/0084388 A1 4/2005 Hayes et al.
2009/0123693 A1* 5/2009 Paul ..... B29C 70/526 428/113
2012/0208003 A1* 8/2012 Beard ..... C04B 20/0048 428/338
2015/0050177 A1* 2/2015 Sigurdsson ..... F04B 1/2007 418/161
2016/0377066 A1 12/2016 Friedrichsen
2018/0282878 A1* 10/2018 Hesebeck ..... C22C 27/04
2019/0145388 A1 5/2019 Ishikawa
2021/0190059 A1* 6/2021 Kim ..... F04B 35/04

FOREIGN PATENT DOCUMENTS

EP 066145 A1 12/1982
EP 0679225 A1 11/1995
EP 0770182 A1 5/1997
EP 1939447 A1 7/2008
EP 3109471 A1 12/2016
JP 2692044 B2 12/1997
JP 20050133647 A 5/2005
WO 9416218 A1 11/1995
WO 9602753 A1 5/1997

OTHER PUBLICATIONS

European Office Action for corresponding European Patent Application No. 22209777.6 dated Oct. 8, 2024.

* cited by examiner

*Primary Examiner* — Bryan M Lettman
(74) *Attorney, Agent, or Firm* — McCormick, Paulding & Huber PLLC

(57) ABSTRACT

A control plate (18) of a hydraulic machine is described, the control plate (18) includes a body (21), an arrangement of openings (22, 23), and a contact face (24). In order to operate a hydraulic machine with a low noise level the body (21) is made of a plastic material. The control plate may be used as port plate or as valve plate.

16 Claims, 3 Drawing Sheets

CONTROL PLATE OF A HYDRAULIC MACHINE AND HYDRAULIC MACHINE

CROSS-REFERENCE TO RELATED APPLICATION

This application claims foreign priority benefits under 35 U.S.C. § 119 from European Patent Application No. 22209777.6, filed Nov. 28, 2022, the content of which is hereby incorporated by reference in its entirety.

TECHNICAL FIELD

The present invention relates to a control plate of a hydraulic machine, the control plate comprising a body, an arrangement of openings, and a contact face.

BACKGROUND

In a hydraulic machine of the rotary type such a control plate is used as port plate or as valve plate. When, for example, the hydraulic machine comprises a cylinder drum which is rotatably arranged in a housing and comprises a number of cylinders, the cylinders must be brought in connection with a supply of hydraulic fluid under pressure, when the machine is used as motor, whereas other cylinders must be brought in connection with a return line. To this end, the control plate is used. The control plate can, for example, comprise an arrangement of openings having at least two kidney-shaped openings one of which being connected to a supply of hydraulic fluid and the other being connected to a return of hydraulic fluid.

In many cases oil is used as hydraulic fluid. Oil has lubricant characteristics, so that parts moving in contact with each other are lubricated and wear can be kept small.

However, when water is used as hydraulic fluid, the fluid is not automatically lubricating the moving parts.

It is therefore known to use a control plate having a coating of a friction reducing plastic material. Such a material is, for example, Polyether Ether Ketone (PEEK), in some cases reinforced with carbon fibres. In order to withstand the pressures within the hydraulic machine, the control plate comprises a body having an insert made of steel. The steel is able to withstand the necessary forces.

It can be observed that during operation of a hydraulic machine equipped with such a control plate the machine produces a considerable noise level.

SUMMARY

The object underlying the invention is to provide means to operate a hydraulic machine with a low noise level.

This object is solved with a control plate of a hydraulic machine as described at the outset in that the body is made of a flat plastic material.

The plastic material is free of a core. The whole thickness of the body is made of the plastic material. Apart from the reduction of the noise level, such a control plate has a number of further advantages. The whole plate can be made thinner since it is not necessary to take into account the ratio between a total thickness of the control plate and the thickness of the steel insert. The control plate is more flexible, so that it can withstand higher forces or transfer the higher forces to parts of the housing in which the control plate is mounted.

In an embodiment of the invention the plastic material comprises friction reducing properties. In such a case the hydraulic machine can be used in connection with water as hydraulic fluid.

In an embodiment of the invention the plastic material is a fibre reinforced plastic material. A plastic material reinforced by fibres shows a good strength, so that the hydraulic machine equipped with such a control plate can be operated with higher hydraulic pressures.

In an embodiment of the invention the plastic material is reinforced by fibres having a length of at least 5 mm. The longer the fibres are, the more stable the control plate is. A coat applied to a steel core of the control plate in the prior art is usually produced by injection moulding. During injection moulding the fibres used for the reinforcement of the plastic material are shortened in an extruder, so that the length of the fibres is usually limited to below 1 mm. Thus, having a fibre length of at least 5 mm gives a considerable strength of the control plate.

In an embodiment of the invention at least in a thickness region adjacent the contact face more than 50% of the fibres include an angle with the contact face of less than 30°. Thus, the fibres are more or less oriented parallel to the contact face so that the counter part of the control plate runs basically in parallel to most of the fibres and does not slide over a surface which is roughened by the ends of the fibres. Tribological contacts are thus in an optimum form. The mostly parallel orientation of the fibres in the material means that there is a higher area of said fibres in contact with the counterpart. This will also improve the wear resistance of said control plate.

In an embodiment of the invention the fibres are arranged in layers. In other words, the fibres are arranged in planes which are arranged substantially parallel to each other and substantially parallel to the contact face. Thus, the fibres reinforce the control plate in a direction parallel to the contact face and thus in the direction in which a higher strength and stiffness is desired. In a direction perpendicular to the contact face, a lower stiffness is of advantage, since in this direction the control plate can show some spring characteristics to dampen noise.

In an embodiment of the invention the layers are stacked in a direction perpendicular to the contact face. This is a simple way to orient the fibres in the desired way. The direction of the fibres can be different between different layers, for ex-ample 0° and 90° or 0° and ±45°. Thus, an anisotropy in the strength and the stiffness can be obtained parallel to the contact face.

In an embodiment of the invention the plastic material comprises a fibre content of at least 55%. This is a rather high fibre content and allows for a high strength of the control plate.

In an embodiment of the invention the fibres are made of carbon and/or ceramic fillers, in particular ceramic nano fillers, for example SiC. Such a filler also in-creases the hardness of plastics. Such fibres or fillers are in particular useful in connection with the use in a hydraulic machine.

In an embodiment of the invention the body is made from a number of prepregs. A prepreg is a prefabricated product which can comprise, for example, a number of parallel oriented fibres which are impregnated with a plastic material in a non-cured state. When the prepregs are placed in the desired form, the fibres can be arranged with different angular orientations in each layer. When the prepregs are stacked, the body can be formed and then cured, for example by pressing and/or heating.

In an embodiment of the invention the contact face comprises a circular sliding track and the surface of the contact face is smoother in the sliding track than in a region of the contact face outside the sliding track. In this case not the whole contact face is used for contact with a counterpart, but only the sliding track. When the sliding track is smoother than the rest of the contact face, friction can be reduced, and wear can be avoided.

In an embodiment of the invention the material of the body is softer than steel. This is true for most of plastic materials.

The object is solved with a hydraulic machine comprising a control plate as de-scribed above. Such a hydraulic machine shows during operation a low noise level.

In an embodiment of the invention the control plate is radially surrounded by a reinforcing ring. The reinforcing ring defines a radial extension of the control plate. Even when higher pressures or forces are applied, the radial dimension of the control plate is maintained.

In an embodiment of the invention the reinforcing ring is made of steel. Steel has enough stiffness not to widen when the control plate is subject to pressures or forces perpendicular to the control face.

BRIEF DESCRIPTION OF THE DRAWINGS

An embodiment of the invention will now be described with reference to the drawing, wherein.

DETAILED DESCRIPTION

Figure 1:
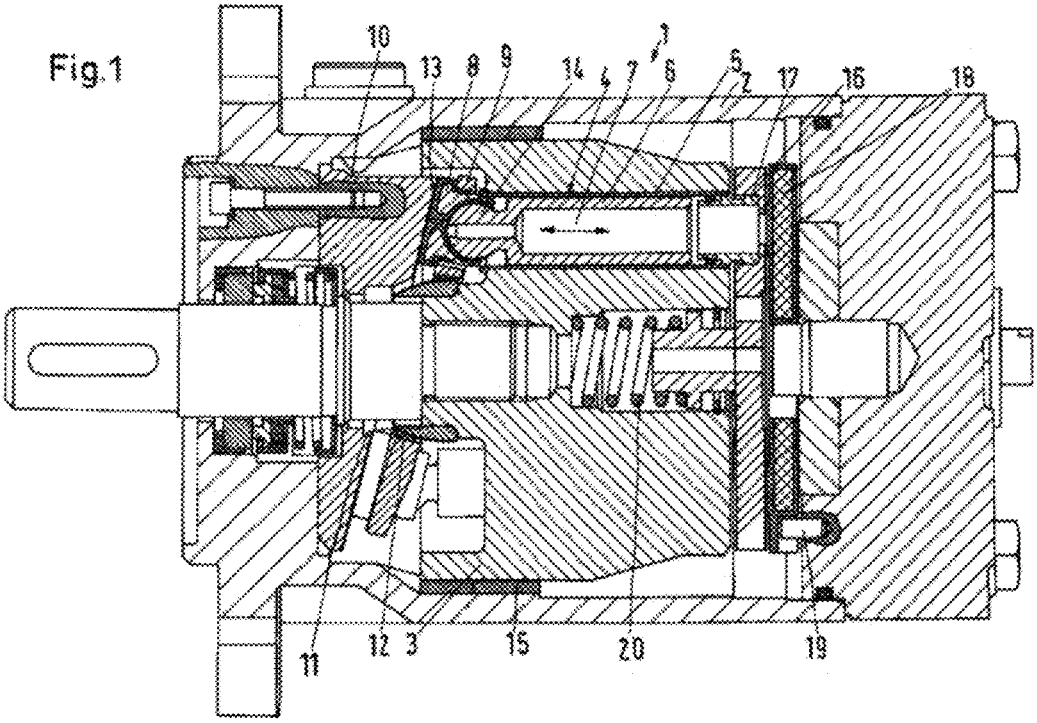
FIG. 1 shows a schematic cross-sectional view of a water-hydraulic machine in the form of an axial piston machine.
Figure 2:
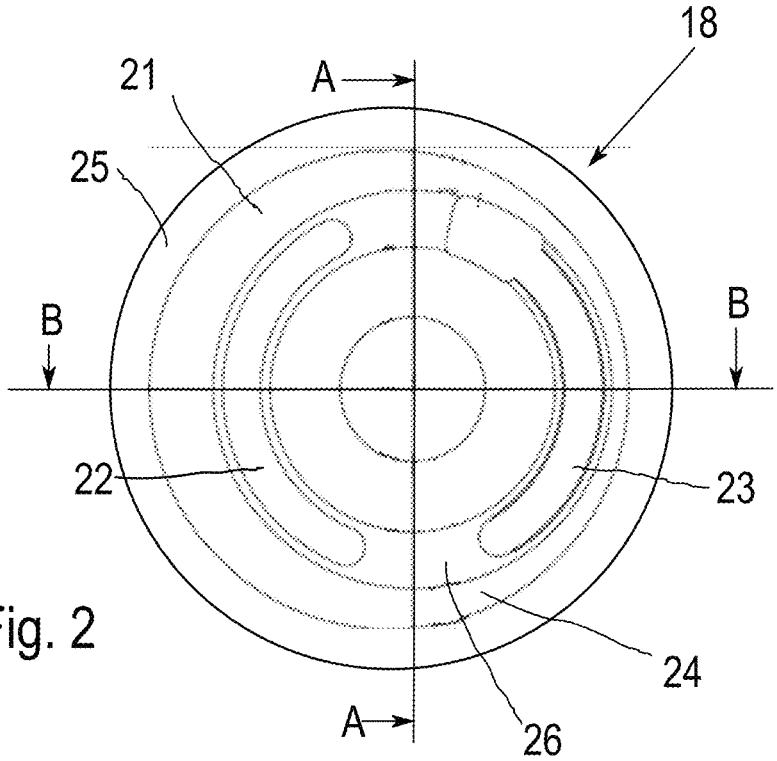
FIG. 2 shows a front view of a control plate.
Figure 3:
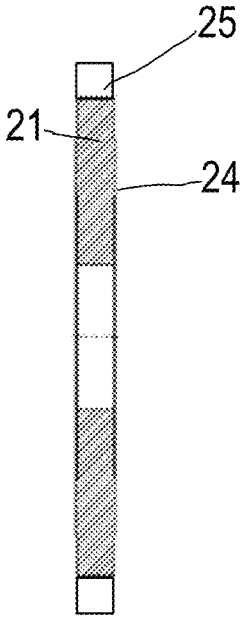
FIG. 3 shows a section A-A of FIG. 2.
Figure 4:
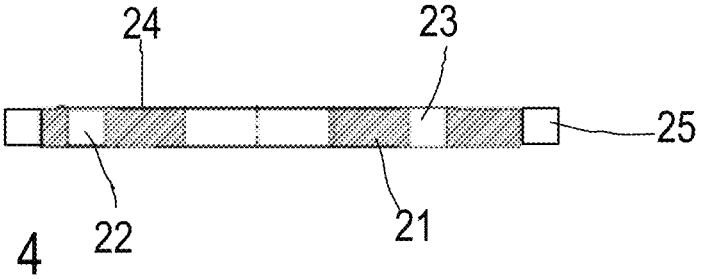
FIG. 4 shows a section B-B of FIG. 2.

FIG. 1 shows a water-hydraulic machine 1 having a housing 2 in which a cylinder drum 3 is rotatably mounted.

At least one cylinder 4 is arranged in the cylinder drum 3. The cylinder 4 is provided with a sleeve 5. Sleeve 5 is formed by a plastic material which is in form of a polymer with a ceramic filler. A piston 6 is moveable in the cylinder 4 in the direction of a double arrow 7. Control of the movement of the piston 6 in cylinder 4 is carried out by a sliding shoe 8 which is held against a swash plate 10 under the action of a hold-down plate 9.

Hold-down plate 9 is supported via a ball joint having a ball 11 on the cylinder drum 3. Ball 11 is composed of duplex steel or super duplex steel. Hold-down plate 9 has an insert 12 composed of the above-mentioned polymer material having ceramic filler in the region of contact with ball 11.

Sliding shoe 8 is sleeved with a mould 13 from polymer with ceramic filler. Mould 13 is extended so far that it comprises a ball 14 at the front end of piston 6, wherein said ball 14 forms a part of a ball joint.

Cylinder drum 3 is mounted in housing 2 on a bearing surface 15 composed of polymer with ceramic filler, i.e. bearing surface 15 forms a radial bearing.

At the end facing away from the swash plate 10, a pressure plate 16 is provided into which sleeves 17 are inserted which themselves produce a connection between pressure plate 16 and cylinders 4. Pressure plate 16 bears against a control plate 18 which is arranged in a stationary manner in housing 2. It is held tight here by a pair of pins 19. Pressure plate rotates jointly with cylinder drum 3 with respect to control plate 18, so that control plate 18 can control the supply and discharge of hydraulic fluid to the cylinder 4 in the correct position.

Pressure plate 16 is pushed against control plate 18 under the force of a spring 20 and by an excess of hydraulic force arising from the pressure distribution on the pressure plate.

The control plate 18 which can also be termed "port plate" comprises a body 21, an arrangement of openings 22, 23, and a contact face 24. The contact face 24 is arranged on the side facing the pressure plate 16. The openings 22, 23 of the opening arrangement are kidney shaped.

The body 21 is made of a flat plastic material. The plastic material comprises friction reducing properties, i.e. a friction between the control plate 18 and the pressure plate 16 is kept low even when water is used as a hydraulic fluid. A suitable plastic material is, for example, PEEK.

The plastic material is a fibre reinforced plastic material having fibres of a length of at least 5 mm.

At least in a thickness region adjacent the contact face 24 more than 50% of the fibres include an angle with the contact face 24 of less than 30%. This can be achieved in a simple way in that the body 21 is built from a number of prepregs which are stacked above each other. A prepreg is a prefabricated material having a large number of fibres arranged in parallel and impregnated with a plastic material in an uncured state. When these prepregs are stacked above each other, a number of layers of fibres is produced, wherein the fibres in the layers are more or less parallel to each other and parallel to the contact face 24. The fibres in the layers can be orientated in different directions, however, basically in parallel to the contact face 24. Thus, the body 21 can be provided with a suitable strength and stiffness in all directions parallel to the contact face 24. In a direction perpendicular to the contact face 24 the body can be slightly compressible to form a spring, so that noise can be dampened.

When prepregs are used to produce the body 21, the plastic material can comprise a fibre content of at least 55%. The fibres are made of carbon or another filler material, like a ceramic filler.

The use of the prepregs has the advantage that the fibre orientation places as many fibres as possible parallel to the contact surface 24, so that tribological contacts can form on the side of the fibres and not at the ends.

There is a greater flexibility in terms of manufacturing, because there is no necessity to have to ensure a uniform thickness of a layer of the plastic material in the kidney-shaped openings 22, 23.

The use of the prepregs has the further advantage that inclusion of air can be avoided. This will result in less dispersion in performance for control plates made of such a composite.

A steel ring 25 is disposed around the body 21 (not shown in FIG. 1). The steel ring guarantees a dimensional stability in the radial direction, i.e. when forces or pressures act on the control plate 18, the body can slightly be compressed, how-ever, it cannot expand in the radial direction.

The contact face 24 comprises a sliding track 26 in which the contact face 24 is smoother than outside the sliding track 26. The pressure plate 26 contacts the control plate 18 only in the region of the sliding track 26.

Figure 5:
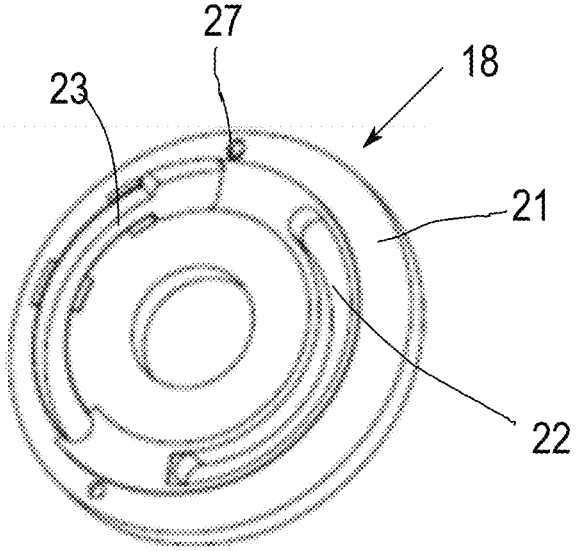
FIG. 5 shows a perspective view of the control plate.

FIG. 5 shows the control plate 18 from the side opposite the contact face 24. A bore 27 for accommodating the positioning pins 19 can be seen.

Figure 6:
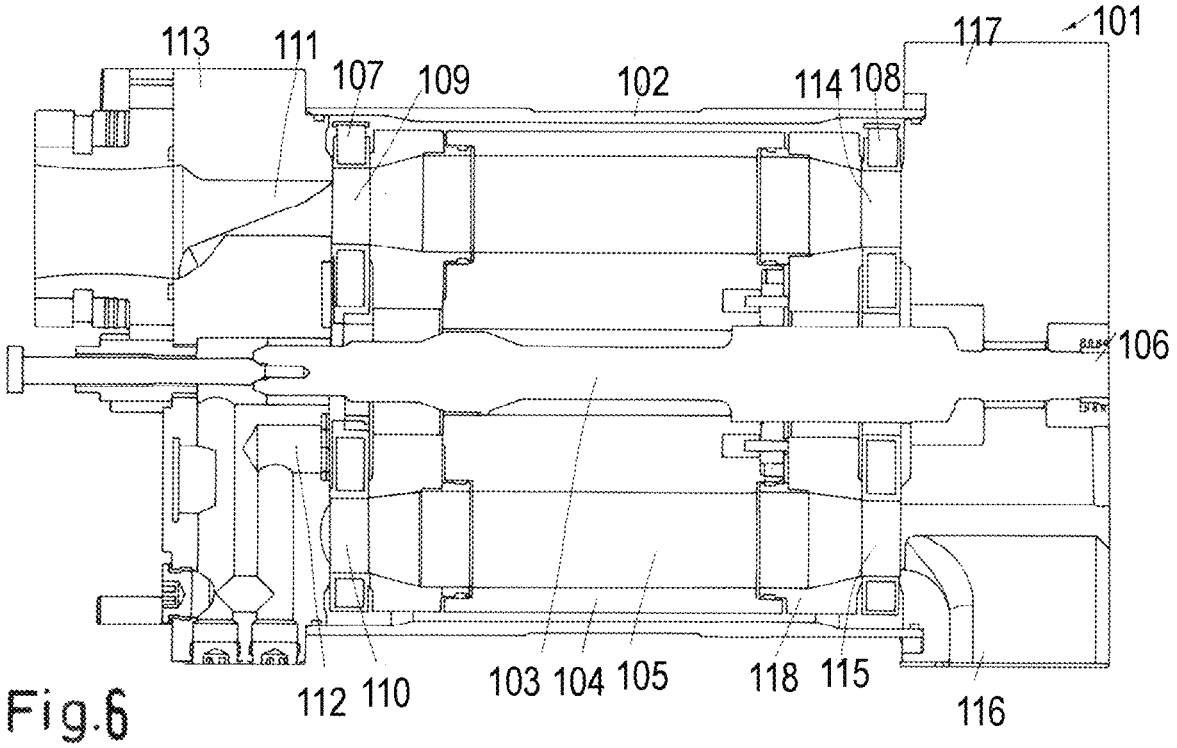
FIG. 6 shows a schematic cross-sectional view of a water-hydraulic machine in the form of a pressure exchanger and FIG. 7 shows a control plate and a detail of the surface of the control plate.

FIG. 6 shows schematically a hydraulic machine in form of a pressure exchanger 101 in which a control plate 18 as described above can be used for the same purpose.

The pressure exchanger 101 comprises a housing 102, a drive shaft 103 and a cylinder drum 104 which is rotatably arranged in the housing 102. The cylinder drum 104 comprises a plurality of cylinders 105 which are evenly distributed in circumferential direction around the drive shaft 103. However, basically one cylinder 105 would be sufficient.

The cylinder drum 104 is rotationally fixed to the drive shaft 103. The drive shaft 103 comprises a driven end 106. The driven end 106 can be provided with a coupling to connect a drive motor or other driving means to rotate the drive shaft 103.

Port flanges 107, 108 are arranged at each end of the cylinder drum 104. The cylinder drum 104 rotates with respect to the port flanges 107, 108. The port flanges 107, 108 can have the construction of the control plate 18 of the embodiment shown in FIGS. 1 to 5.

First port flange 107 comprises two kidney-shaped openings 109, 110 which are connected to ports 111, 112 in an end part 113 of the housing 102. The second port flange 108 comprises two kidney-shaped openings 14, 15 which are connected to port 116 (the other port is not shown) in a second end part 117 of the housing 102.

A pressure shoe 118 is arranged between the cylinder drum 104 and the second port flange 108. The pressure shoe 118 is sealed with respect to the cylinders 105 of the cylinder drum 104 and is slightly moveable with respect to the cylinder drum 104, so that during operation it can be held in contact with the second port flange 108.

Even in this case, the port flanges 107, 108 can be made without an insert of steel or other metal. The port flanges 107, 108 are made of a flat plastic material.

Figure 7:
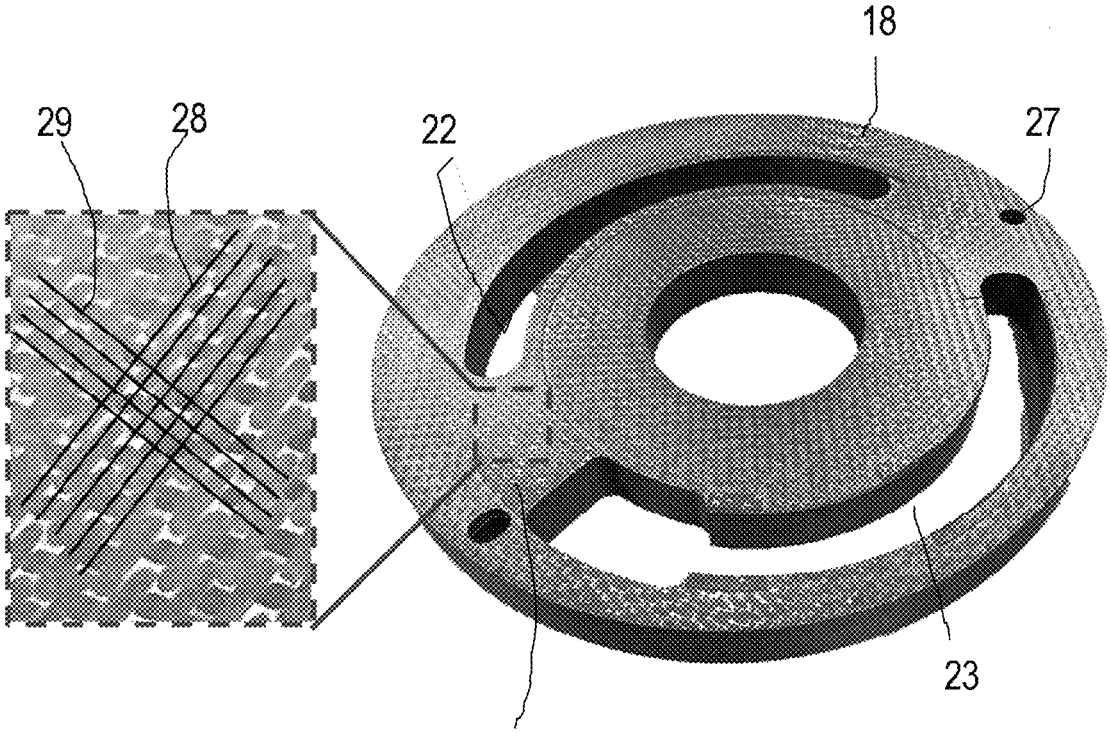

FIG. 7 shows the control plate 18 in a perspective view. The same numeral as in FIGS. 1 to 5 are used.

FIG. 7 shows an enlarged view of the surface of the control plate 18 in the region of the sliding track 26. Schematically shown are fibres 28, 29 which are arranged substantially parallel to the surface of the control plate 18. The fibres 28 are arranged with an angle of approximately 90° with respect to the fibres 29. This can be realized by using a first prepreg comprising the fibres 28 and stacking another prepreg on the first prepreg, wherein the other prepreg comprises the fibres 29 and is arranged with the mentioned angular orientation with respect to the first prepreg.

While the present disclosure has been illustrated and described with respect to a particular embodiment thereof, it should be appreciated by those of ordinary skill in the art that various modifications to this disclosure may be made without departing from the spirit and scope of the present disclosure.

What is claimed is:

1. A control plate for slidably engaging a pressure plate of a hydraulic machine, the control plate comprising a body, an arrangement of openings, and a contact face, wherein the body is made of a flat plastic material, wherein the plastic material is a fibre reinforced plastic material, wherein the fibre reinforced plastic material includes fibres arranged in layers, and wherein the layers are stacked in a direction perpendicular to the contact face.

2. The control plate according to claim 1, wherein the plastic material comprises friction reducing properties.

3. The control plate according to claim 1, wherein at least in a thickness region adjacent the contact face more than 50% of the fibres include an angle with the contact face of less than 30°.

4. The control plate according to 3, wherein the plastic material comprises a fibre content of at least 55%.

5. The control plate according to claim 1, wherein the plastic material comprises a fibre content of at least 55%.

6. The control plate according to claim 1, wherein the fibres are made of carbon and/or a ceramic filler.

7. The control plate according to claim 1, wherein the body is made from a number of prepregs.

8. The control plate according to claim 1, wherein the contact face comprises a circular sliding track and the surface of the contact face is smoother in the sliding track than in a region of the contact face outside the sliding track.

9. The control plate according to claim 1, wherein the material of the body is softer than steel.

10. A hydraulic machine comprising the control plate according to claim 1.

11. The hydraulic machine according to claim 10, wherein the body of the control plate is radially surrounded by a reinforcing ring.

12. The hydraulic machine according to claim 11, wherein the reinforcing ring is made of steel.

13. A control plate for slidably engaging a pressure plate of a hydraulic machine, the control plate comprising a body, an arrangement of openings, and a contact face, wherein the body and the contact face are made from a plurality of fibre reinforced prepreg layers and wherein a fibre reinforced prepreg layer forming the contact face is parallel to the contact face.

14. The control plate according to claim 13, wherein at least in a thickness region adjacent the contact face more than 50% of the fibres include an angle with the contact face of less than 30°.

15. A control plate for slidably engaging a pressure plate of a hydraulic machine, the control plate comprising a body, an arrangement of openings, and a contact face, wherein the body and the contact face are made of a plastic material reinforced by fibres, and wherein at least in a thickness region adjacent the contact face more than 50% of the fibres include an angle with the contact face of less than 30°.

16. The control plate according to claim 15, wherein the plastic material comprises a fibre content of at least 55%.

* * * * *